US005497734A

United States Patent [19]

Okada

[11] Patent Number: 5,497,734

[45] Date of Patent: Mar. 12, 1996

[54] COOLING SYSTEM FOR LIQUID-COOLED ENGINE

[75] Inventor: Hiroshi Okada, Yokohama, Japan

[73] Assignee: Nissan Motor Co., Ltd., Yokohama, Japan

[21] Appl. No.: 357,293

[22] Filed: Dec. 13, 1994

[30] Foreign Application Priority Data

| | | | |
|---|---|---|---|
| Dec. 22, 1993 | [JP] | Japan | 5-324800 |
| Dec. 22, 1993 | [JP] | Japan | 5-324801 |
| Dec. 27, 1993 | [JP] | Japan | 5-331803 |

[51] Int. Cl.[6] ..... F01P 3/02

[52] U.S. Cl. ..... 123/41.1; 123/41.29; 123/54.4

[58] Field of Search ..... 123/41.1, 41.74, 123/41.29, 54.4, 54.5, 54.6, 54.7

[56] References Cited

U.S. PATENT DOCUMENTS

| | | | |
|---|---|---|---|
| 4,370,950 | 2/1983 | Furukubo | 123/41.1 |
| 4,381,736 | 5/1983 | Hirayama | 123/41.1 |

FOREIGN PATENT DOCUMENTS

| | | |
|---|---|---|
| 58-162716 | 9/1983 | Japan . |
| 63-96227 | 6/1988 | Japan . |
| 1-65993 | 4/1989 | Japan . |

*Primary Examiner*—Noah P. Kamen
*Attorney, Agent, or Firm*—Foley & Lardner

[57] ABSTRACT

A cooling system for a liquid-cooled engine, comprises a cylinder head water jacket, a cylinder block water jacket, a water pump, a radiator thermostat for restricting circulation of cooling water through a radiator when the engine is cold, a first return passage for returning coolant coming from a cylinder head water jacket to a pump inlet, and a second return passage for returning coolant coming from a cylinder block water jacket to the pump inlet. The second return passage joins the first return passage at a junction so that a flow of coolant coming from the cylinder block water jacket joins a flow of coolant coming from the cylinder head water jacket. A thermostatic valve is disposed in the junction of the first and second return passages and has a thermosensitive portion exposed to the first return passage for establishing fluid communication between the second return passage and the first return passage depending on the coolant temperature of the first return passage.

10 Claims, 8 Drawing Sheets

COOLING SYSTEM FOR LIQUID-COOLED ENGINE

BACKGROUND OF THE INVENTION

1. Field of the Invention

The present invention relates to an engine cooling system, in particular, relates to a cooling system for a liquid-cooled engine equipped with an additional thermostat downstream of a cylinder block water jacket in addition to a radiator thermostat, which system allows a parallel coolant circulation through a cylinder block water jacket and through a cylinder head water jacket when the engine is hot and allows a coolant circulation through only the cylinder head water jacket when the engine is cold.

2. Description of the Prior Art

Recently, there have been proposed and developed various engine cooling systems which can improve an engine warm-up performance and/or an engine cooling action. For instance, Japanese Patent Provisional Publication (Tokkai Showa) No. 58-162716 teaches the provision of an additional thermostat which is disposed downstream of a cylinder block water jacket to block a flow of cooling water (coolant) flowing therethrough, when a sensed cooling water temperature is below a predetermined temperature, such as during cold starts. The conventional cooling device for a water-cooled engine described in the Japanese Patent Provisional Publication No. 58-162716, would suppress excessive cooling of cylinder blocks while properly cooling the cylinder head, by opening and closing the additional thermostat depending on the coolant temperature sensed at the outlet passage of the cylinder block water jacket. Thus, the above-noted prior art device allows a cylinder head, cylinder walls, pistons, valve seats, and other working parts to more quickly reach to operating temperatures, thereby shortening an inefficient cold-operating time, and minimizing frictional loss between the pistons and the engine cylinders, and maintaining the working parts at efficient, but not excessive, temperatures. However, in the above-noted conventional device, since the thermosensitive portion of the thermostat is provided at the outlet passage of the cylinder block water jacket, with the engine cold and the thermostat thus closed, the flow of water flowing around the thermosensitive portion is disturbed, thereby causing stagnant cooling water at the outlet passage of the cylinder block water jacket. Under this condition, an accuracy of sensing a temperature of the coolant coming from the cylinder block water jacket is lowered. That is, with the thermostatically controlled valve closed, the coolant temperature cannot be sensed precisely by the thermosensitive portion of the thermostat owing to the stagnant coolant standing at the outlet passage of the cylinder block water jacket. Therefore, in the event that the coolant temperature sensed by the thermosensitive portion is less than the actual temperature of coolant flowing through the cylinder block water jacket and thus the valve-opening operation of the thermostat is retarded, there is a possibility of over-heat of the cylinder liners. In contrast to the above, when the coolant temperature sensed by the thermosensitive portion is greater than the actual coolant temperature coming from the cylinder block water jacket and thus the valve-opening operation of the thermostat is advanced, the cylinder walls will be cooled undesirably. In this case, there is a possibility that engine thermal efficiency is lowered and engine warm-up performance is lowered when the engine is warming up or cold.

Japanese Utility Model First Publication (Jikkai Showa) No. 63-96227 discloses a cooling water return passage arrangement for a V-type engine in which engine cylinders are arranged in two rows, or banks. In the V-type engines, engine cooling is traditionally achieved by circulation of coolant flowing through two banks of cylinder block water jackets and cylinder head water jackets. As is generally known, the coolant used for cooling the right and left banks flows through the radiator to the water pump. In the coolant return passage arrangement of the Japanese Utility Model First Publication (Jikkai Showa) No. 63-96227, the coolant return passage is arranged so that a return passage of coolant coming from either one of right and left banks joins with a return passage of coolant coming from the other bank at a confluence provided at the outlet of the water jacket of the other bank. Thus, coolant coming from the water jackets would be returned efficiently to the radiator. In this prior art, since two banks are offset to each other and the confluence or junction is arranged at an end of one backward projected bank of cylinder block and additionally owing to a greater effective cross-sectional area of the coolant passage at the confluence, the entire length of the V-type engine tends to be considerably increased.

On the other hand, Japanese Utility Model First Publication (Jikkai Heisei) No. 1-65993 teaches the provision of a plurality of thermostats in the coolant passage between the cylinder head and the inlet hose of the radiator, in order to more precisely control the flow rate of coolant flowing through the radiator. However, in the prior art thermostat arrangement described in the Japanese Utility Model First Publication No. 1-65993, thermosensitive portions of the respective thermostats are arranged in parallel with a stream line of the coolant flowing through the return passage to the radiator so that the thermosensitive portions are aligned with each other on the center line of the return passage. In general, the upstream thermostat is more sensitive to the coolant temperature as compared with the downstream thermostat, owing to the in-line arrangement of the plural thermostats along the center line of the coolant passage. Thus, there is a greatly increased tendency for the valve-opening operation of the upstream thermostat to become advanced. In other words, there is a greatly increased tendency for the valve-opening operation of the downstream thermostat to become retarded.

SUMMARY OF THE INVENTION

Accordingly, it is an object of the invention to provide an improved cooling system for a liquid-cooled engine which avoids the foregoing disadvantages of the prior art.

It is another object of the invention to provide an improved engine cooling system for a liquid-cooled engine equipped with an additional thermostat downstream of a cylinder block water jacket, which can provide a precise opening and closing operation of the additional thermostat by precisely estimating or sensing a temperature of coolant coming from the cylinder block water jacket, so as to provide both a proper cooling action and a high warm-up performance.

It is a further object of the invention to provide an improved cooling system suitable for a liquid-cooled V-type engine in which the entire length of the engine can be minimized, while assuring a reliable cooling action.

In order to accomplish the aforementioned and other objects of the invention, a cooling system for a liquid-cooled engine, comprises a cylinder head water jacket, a cylinder block water jacket, a water pump arranged for forcing cooling water from its pump outlet to each of the water jackets, a radiator thermostat for restricting circulation of cooling water through a radiator when the engine is cold, a first return passage for returning cooling water coming from the cylinder head water jacket to a pump inlet of the water pump, a second return passage for returning cooling water coming from the cylinder block water jacket to the pump inlet, the second return passage joining the first return passage at a junction so that a flow of cooling water coming from the cylinder block water jacket joins a flow of cooling water coming from the cylinder head water jacket, and thermostatic valve means disposed in the junction of the first and second return passages and having a thermosensitive portion exposing into the first return passage so that a fluid communication between the first and second return passages is established when a temperature of cooling water flowing through the first return passage is above a predetermined temperature. The thermostatic valve means may comprise at least two adjacent thermostats. It is preferable that the thermostats are arranged so that a center portion of the thermosensitive portion of each thermostat is offset from a center axial line of the first return passage., For the purpose of minimizing the entire length of the engine, the offset direction of the center portion of the thermosenstive portion is a direction of the center of the egnine. Each of the thermostats consists of a wax-pellet thermostat. The thermosensitive portion of each thermostat consists of a wax casing of the wax-pellet thermostat. An offset between the center portion of the thermosensitive portion and the center axial line of the first return passage is preferably set to be greater than a radius of the wax casing.

Alternatively, the thermostats may be arranged so that a line segment joining center portions of thermosensitive portions of each thermostats is arranged obliquely to a center axial line of the first return passage towards the center of the engine.

According to another aspect of the invention, a cooling system for a liquid-cooled V-type engine equipped with two banks of cylinder head water jackets and cylinder block water jackets, comprises a water pump arranged for forcing cooling water from its pump outlet to each of the water jackets, a radiator thermostat for restricting circulation of cooling water through a radiator when the engine is cold, a first return passage connected to an outlet of a first bank of cylinder head water jacket at its upstream portion and to an outlet of a second bank of cylinder head water jacket at its downstream portion, for returning cooling water coming from the cylinder head water jackets to a pump inlet of the water pump, a second return passage for returning cooling water coming from the cylinder block water jackets to the pump inlet, the second return passage joining the first return passage at a junction so that a flow of cooling water coming from the cylinder block water jackets joins a flow of cooling water coming from the cylinder head water jackets, and thermostatic valve means disposed in the upstream portion having a greater outflow resistance than the downstream portion, the thermostatic valve means being sensitive to a temperature of cooling water coming from the first bank of cylinder head water jacket so that a fluid communication between the first and second return passages is established when the temperature of cooling water coming from the first bank of cylinder head water jacket is above a predetermined temperature.

A further aspect of the invention, a cooling system for a liquid-cooled V-type engine equipped with left and right banks of cylinder heads and blocks, the left and right banks being offset to each other, comprises a water pump arranged at a front bank-offset space so that a pump outlet of the water pump is connected to left and right banks of water jackets, and a return passage connected to an outlet of a left bank of cylinder head water jacket at its upstream portion and to an outlet of a right bank of cylinder head water jacket at its downstream portion, for returning cooling water coming from the cylinder head water jackets to a pump inlet of the water pump. A junction between the return passage and the outlet of the left bank of cylinder head water jacket is provided at a rear bank-offset space. The return passage is arranged along and close to an outer periphery of the engine and branched into an inlet passage of a radiator and a bypass passage connected to the pump inlet.

DESCRIPTION OF THE PREFERRED EMBODIMENTS

Figure 1:
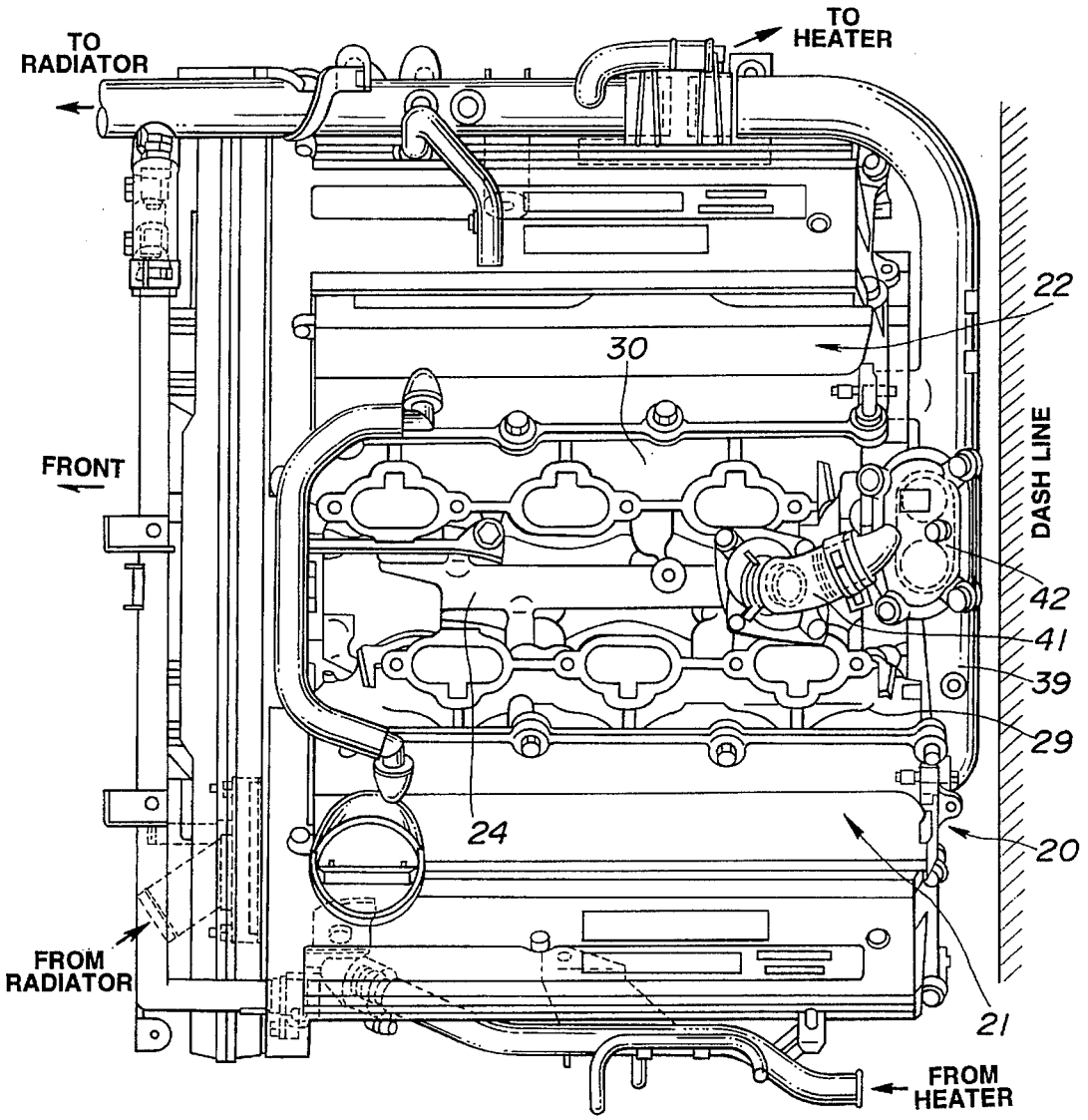
FIG. 1 is a schematic plan view illustrating a V-6 engine including an engine cooling system disposed in accordance with the principles of the present invention.
Figure 2:
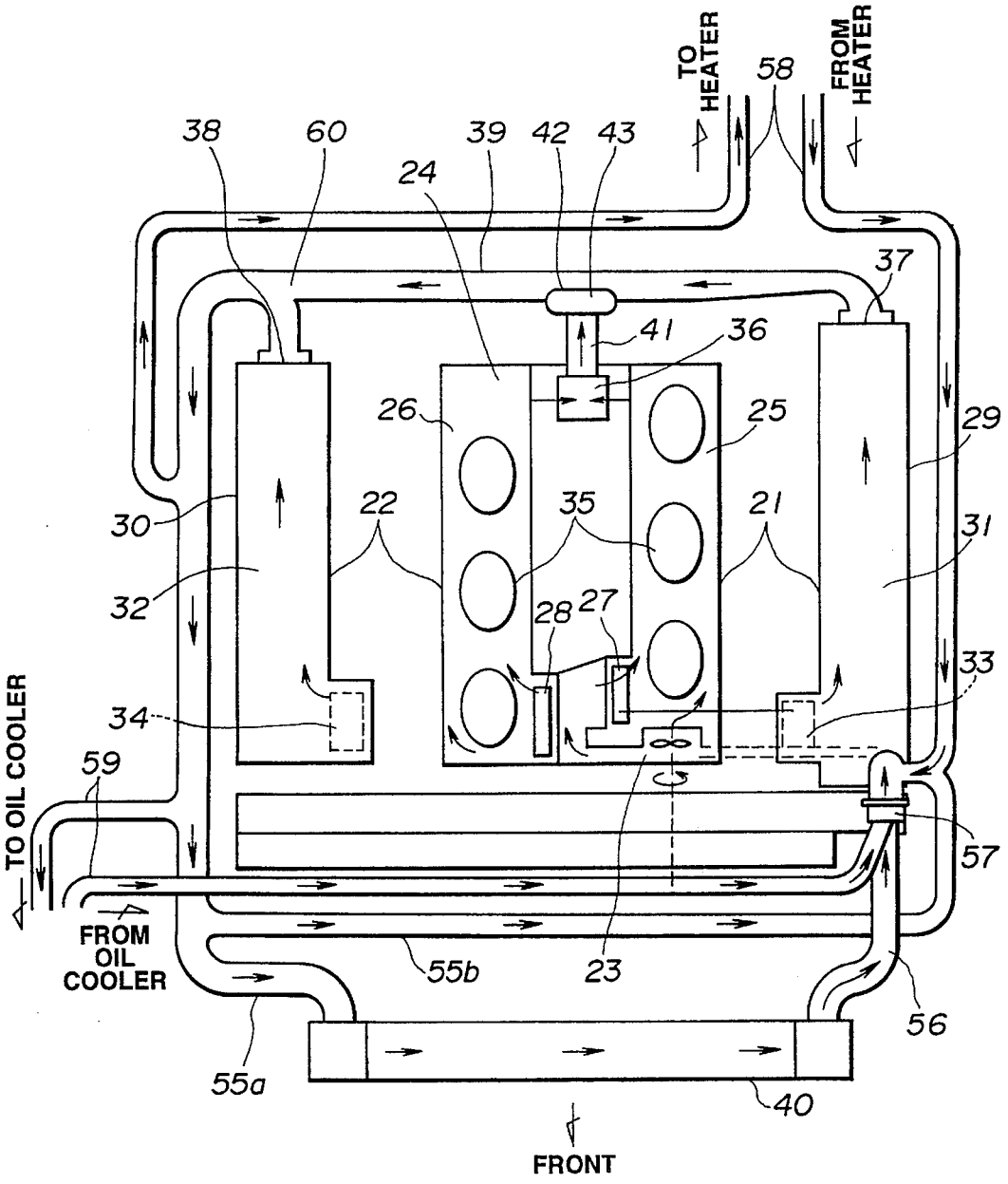
FIG. 2 is an illustration of coolant passages of a preferred embodiment.
Figure 3:
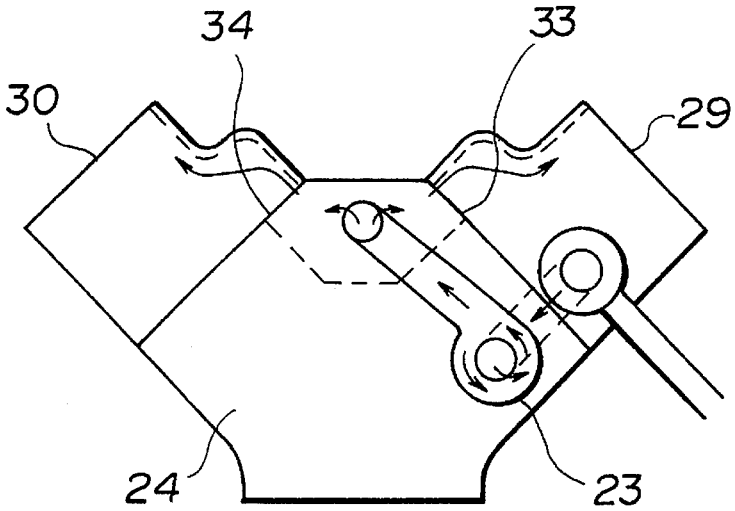
FIG. 3 is a front side view illustrating the coolant passages of the embodiment.
Figure 4:
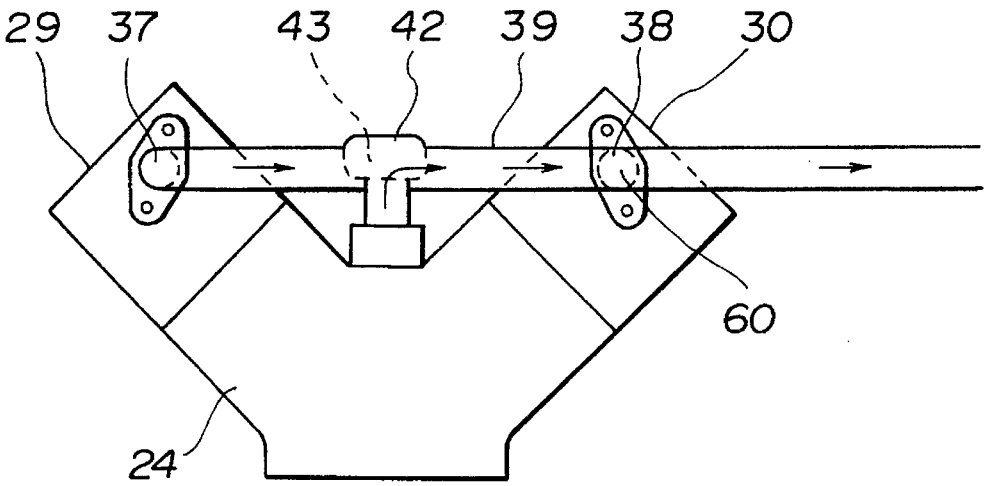
FIG. 4 is a back side view illustrating the coolant passages of the embodiment.
Figure 5:
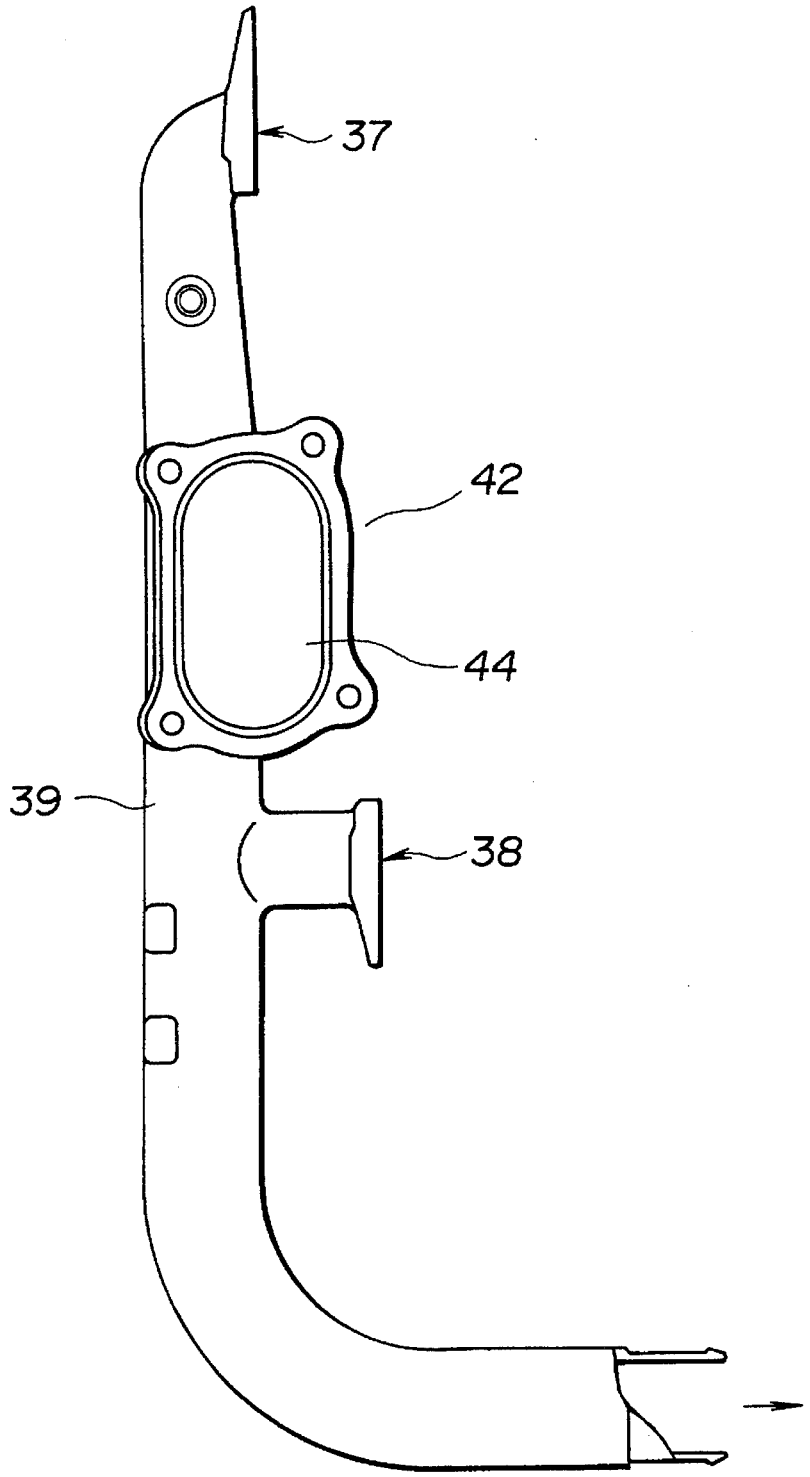
FIG. 5 is a plan view illustrating a first return passage for coolant in the cooling system of the embodiment.

Referring now to the drawings, particularly to FIG. 1, the engine cooling system of the invention is exemplified in case of a V-6 engine with a left bank of cylinder block-and-head and a right bank of cylinder block-and-head, whose banks are offset from each other in the longitudinal direction of the engine. As seen in FIG. 1, the right bank 22 is offset from the left bank 21 in a manner which is slightly projected in the forward direction. In other words, the left bank 21 is offset from the right bank 22 in a manner which is slightly retracted in the backward direction. With the above-noted bank offset arrangement, two advantageous spaces are defined. One space is a front-left bank-offset space which is defined at the front end of the left bank 21, while the other space is a rear-right bank-offset space which is defined at the rear end of the right bank 22. As shown in FIGS. 2 through 4, a water pump 23 is provided in the front-left space. As seen in FIG. 2, an engine cylinder block 24 includes six cylinders 35, a left bank of cylinder block water jacket 25 necessary to cool the left row of cylinder walls and a right bank of cylinder block water jacket 26 necessary to cool the right row of cylinder walls, while left and right cylinder heads 29 and 30 include left and right cylinder head water jackets 31 and 32, respectively. The outlet of the water pump 23 is communicated through the bank center of the two banks 21 and 22 with respective inlet ports 27 and 28 of the left and right cylinder block water jackets 25 and 26. The outlet of the water pump 23 is also communicated through the bank center with respective inlet ports 33 and 34 of the left and right cylinder head water jackets 31 and 32. That is, the left water jackets 25 and 31 are arranged in parallel with the right water jackets 26 and 32, with respect to the outlet of the water pump 23. The left cylinder block water jacket 25 is placed around the left bank of cylinder walls, while the right cylinder block water jacket 26 is placed around the right bank of cylinder walls, thereby efficiently cooling the respective cylinder walls. The left cylinder block water jacket 25 joins the right cylinder block water jacket 26 at the common outlet 36 of them. As seen in FIGS. 2 and 4, the left cylinder head water jacket 31 has an outlet 37, while the right cylinder head water jacket 32 has an outlet 38 formed separately from the outlet 37. As is generally known, the cylinder head water jackets 31 and 32 are mainly placed around inlet valve seats and outlet valve seats, so as to maintain the cylinder head, the valve seats and other working parts at efficient operating temperatures. The left cylinder head water jacket 31 is connected to a first cooling water return passage 39 at the outlet 37 thereof. Similarly, the right cylinder head water jacket 32 is connected to the first cooling water return passage 39 at the outlet 38 thereof. The first return passage 39 is bent from the outlet 37 of the left cylinder head water jacket 31 towards the bank center in a manner which passes through the space defined at the rear end of the right bank 22 and extends towards the outlet 38 of the right cylinder head water jacket 32, and thus joins the outlet 38. A cross-sectional area (flow path area) of the first return passage 39 is designed to be gradually increased from the outlet 37 of the left cylinder head water jacket 31 down to the bank center, so that the diameter of the first return passage 39 is enlarged towards the end wall of the engine (See FIG. 5). As seen in FIG. 2, the downstream section of the first return passage 39 is arranged to extend in the forward direction of the engine in such a manner as to be placed along the outer periphery of the right bank of cylinder head 30. The downstream end of the first return passage 39 is connected through a bypass passage **55*b* to the inlet of the water pump 23. Additionally, the downstream end of the first return passage 39 is connected to an inlet passage (upper hose) 55*a* of a radiator 40 which is usually placed at the front of the engine. On the other hand, an outlet passage (lower hose) 56 of the radiator 40 is connected to the inlet of the pump 23 through a radiator thermostat 57**.

Figure 6:
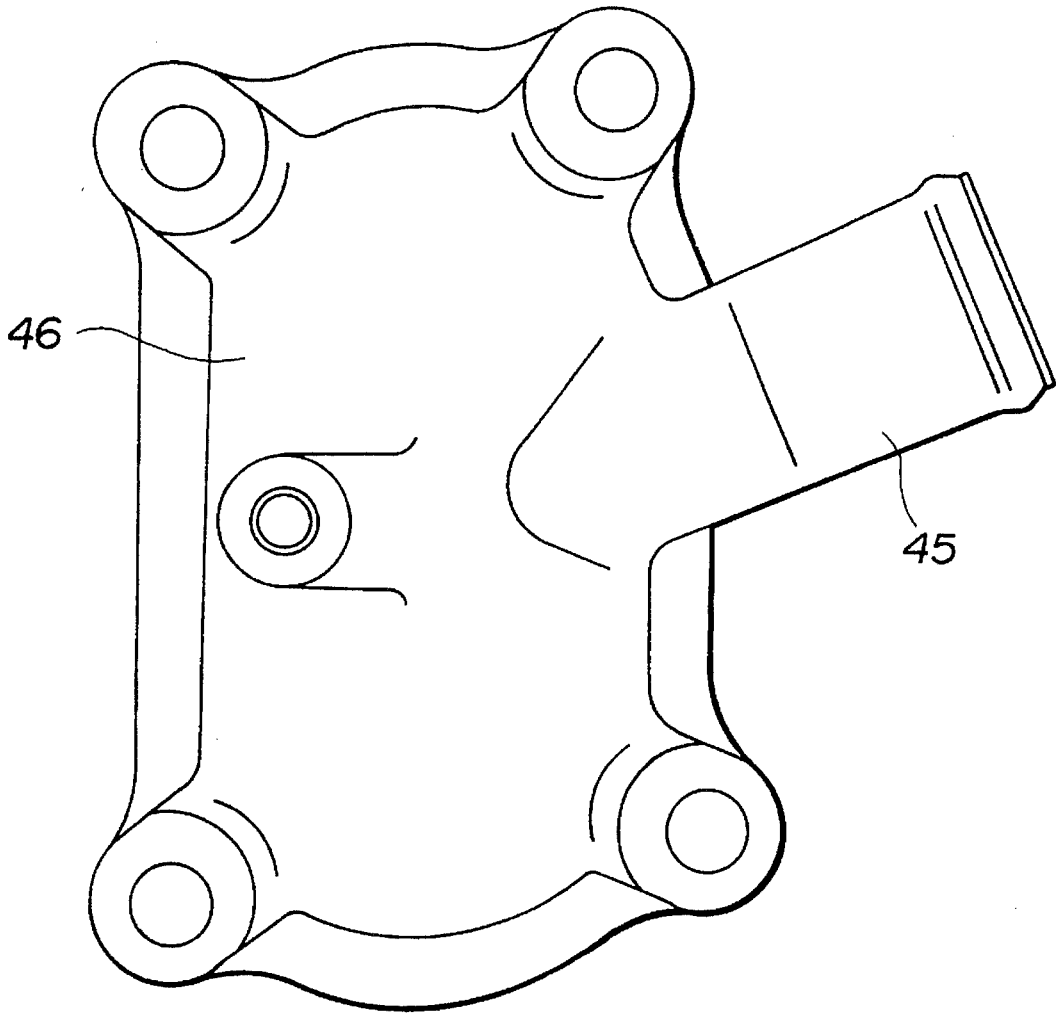
FIG. 6 is a plan view illustrating a cover provided at the confluence of first and second return passages included in the cooling system disposed in accordance with the principles of the present invention.
Figure 7:
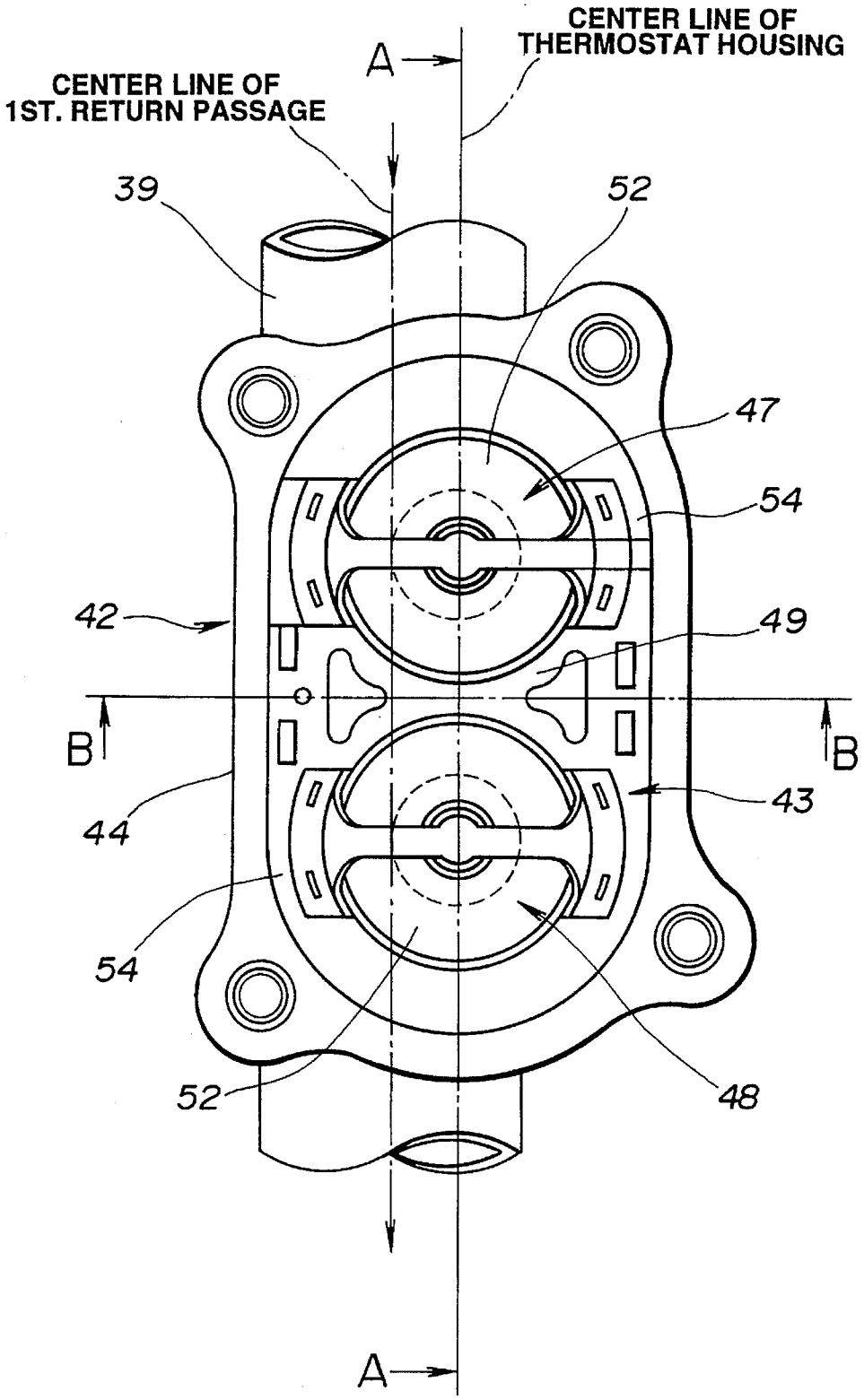
FIG. 7 is a plan view illustrating thermostats disposed in the confluence of the first and second return passages.
Figure 8:
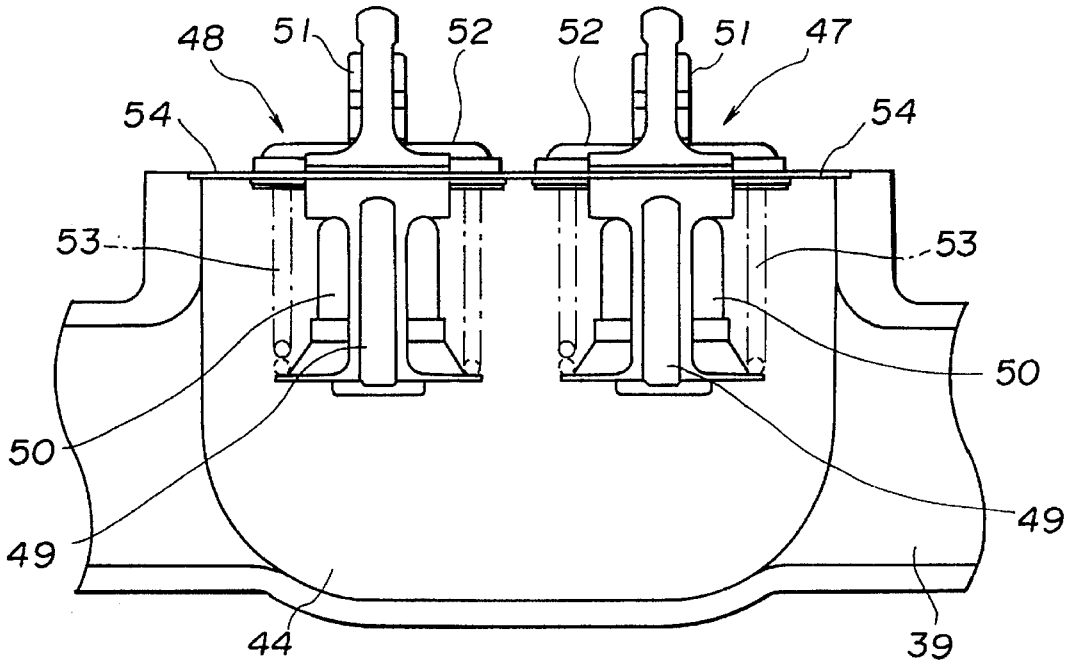
FIG. 8 is a cross-sectional view taken along the line A—A of FIG. 7.
Figure 9:
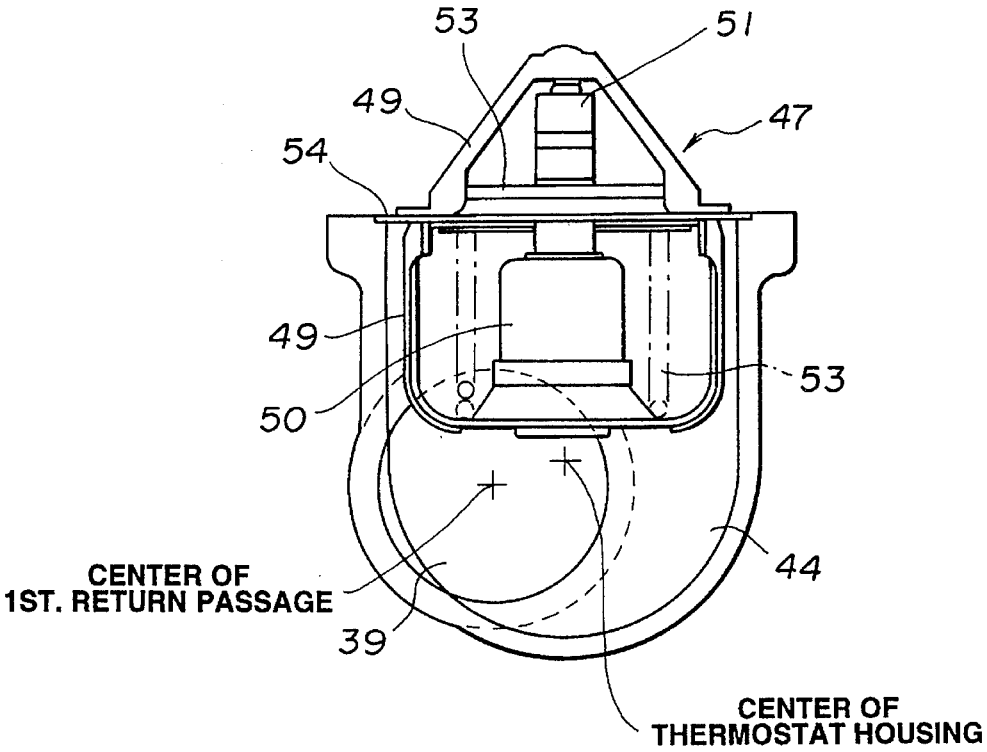
FIG. 9 is a cross-sectional view taken along the line B—B of FIG. 7.

A second cooling water return passage 41 is connected to the common outlet 36 of the left and right cylinder block water jackets 25 and 26. The second return passage 41 joins the first return passage 39 between the two outlets 37 and 38 both connected to the first return passage 39 at different connection points. As best seen in FIG. 1, an additional thermostatic valve device 43 is provided at the confluence or junction 42 between the first and second return passages 39 and 41. As clearly shown in FIG. 7, the conduit defining the first return passage 39 is formed with a thermostat housing 44. Note that the center line of the thermostat housing 44 is not aligned with the center line of the first return passage 39 (a center stream line of cooling water flowing through the first return passage 39). In the cooling system of the embodiment, the center line of the thermostat housing 44 and the center line of the first return passage 39 are parallel to each other and offset to each other. The thermostat housing 44 is so formed that a portion of the inner peripheral wall of the first return passage 39 is enlarged towards the back end surface of the engine or towards the center of the engine. The thermostat housing 44 is formed with an upper opening which is usually closed by way of a cover 46 with a connection tube 45 (See FIG. 6). The second return passage 41 is connected through the connection tube 45 to the thermostat housing 44. As shown in FIGS. 7 and 8, the thermostatic valve device 43 includes a first (upstream) thermostat 47 and a second (downstream) thermostat 48 which thermostats are assembled in the thermostat housing 44 by means of a thermostat support 49. In the embodiment, the respective thermostat consists of a traditional wax-pellet thermostat which is comprised of a substantially cylindrical wax casing 50 filled with a wax pellet, a piston 51, a thermostatic valve 52 integrally connected to the wax casing, and a return spring 53 biasing the valve 52 in its closed position. The wax casing 50 serves as a thermosensitive portion of the thermostat. Note that the wax casings 50 of the thermostats 47 and 48 are placed in the thermostat housing 44 in a manner which are exposed to the cooling water (coolant) flowing through the first return passage 39. Thus, the thermosensitive wax casings 50 are sensitive to a temperature of cooling water flowing through the first return passage 39. As seen in FIG. 8, the thermostat support 49 is formed integrally with a flange 54. When assembling, the flange 54 is fixed on the inner wall of the thermostat housing 44, while the thermostats 47 and 48 are firmly fitted to the flange 54 of the thermostat support 49, and then the cover 46 is attached to the thermostat housing 44 to seal the upper opening of the housing 44 in a fluid-tight fashion. As set forth above, since the center line of the thermostat housing 44 and the center axial line or the center stream line of the first return passage 39 are arranged to be offset from each other, and the thermosensitive portions of the wax casings 50 are also arranged to be offset from the center axial line of the first return passage 39 in a direction of the center of the engine. At this time, it is preferable that the offset between the center line of the first return passage 39 and the center line of the thermostat housing 44 is set to be greater than a radius of the cylindrical wax casing 50, so as to prevent a thermosensitive characteristic of the downstream side thermosensitive wax casing 50 of the thermostat 48 from being affected by the installation position of the upstream side wax casing 50 of the thermostat 47. With the thermostats 47 and 48 offsetting from the center stream line of cooling water flowing through the first return passage 39, the downstream thermostat 48 is sensitive to the temperature of coolant flowing through the first return passage 39 to the same degree as the upstream thermostat 47. In order that the upstream and downstream thermostats 47 and 48 exhibit the same sensitiveness to the temperature of coolant flowing through the first return passage 39, the wax casings 50 may be placed in the thermostat housing 44 and outside of the inner peripheral wall of the conduit defining the first return passage 39, in a manner which are considerably offset from the center stream line of the first return passage 39. In a conventional manner, the first wax-pellet thermostat 47 is powered by a wax pellet which expands with increasing temperature and opens the valve 52 by moving the wax casing 50 downwards (viewing FIG. 8) against the bias of the spring 53 by virtue of the piston 51 when the sensed coolant temperature becomes greater than a predetermined temperature (e.g. a thermostat operating temperature of 95° C.). On the other hand, the second wax-pellet thermostat 48 is provided as a safety valve which is so designed to open when the temperature of cooling water (coolant) flowing through the first return passage 39 reaches to a predetermined upper limit. The predetermined upper limit of the coolant temperature for the second thermostat 48 is set at a temperature slightly greater than the predetermined operating temperature or valve-open temperature for the first thermostat 47. It will be appreciated that the first thermostat 47 can precisely operate with a high response, since its thermosensitive wax casing 50 is arranged to sense the temperature of coolant flowing through the first return passage 39 upstream of the thermosensitive wax casing 50 of the second thermostat 48. As previously noted, the radiator thermostat 57 is disposed in the radiator outlet passage 56 connected to the inlet of the water pump 57, in such a manner as to fully close the radiator outlet passage 56 when the coolant temperature sensed at the inlet side of the water pump is below a preselected temperature (e.g. 82° C.) and to open the passage 56 when the sensed coolant temperature is above the preselected temperature. In FIG. 2, reference numeral 58 denotes a pair of tubes used for a hot-coolant car heater, while reference numeral 59 denotes a pair of tubes for a water-cooled engine oil cooler.

With the above-noted arrangement, in case that the first and second thermostats 47 and 48 are opened by sensing a temperature of coolant flowing through the first return passage 39, the opened thermostats 47 and 48 act to communicate the second return passage 41 with the first return passage 39. In this case, since the thermosensitive wax casings 50 of the respective thermostats 47 and 48 are arranged to be offset from the center stream line or the center axial line of the first return passage 39, the thermosensitive wax casing 50 of the upstream thermostat 47 and the thermosensitive wax casing 50 of the downstream thermostat 48 are exposed uniformly and adequately to the cooling water (coolant) flowing through the first return passage 39, thereby enhancing thermosensitive characteristics of the respective thermostats 47 and 48. Thus, depending on the coolant temperature at the first return passage 39, the respective thermostats 47 and 48 can be opened or closed precisely, without any time delay. In the embodiment, since two thermostats 47 and 48, respectively having a different valve-open temperature characteristic, are disposed in the thermostat housing 44, the cooling system can accurately adjust a flow rate of coolant returned through the first return passage 39 back to the radiator 40. Assuming that three or more thermostats, respectively having a different valve-open temperature characteristic, are disposed in the housing 44, such a cooling system may adjust the flow rate of coolant returned to the radiator more accurately. Also, since the thermostat housing 44 is so formed that a portion of the first return passage 39 is enlarged to be offset towards the back end surface of the engine, a coolant passage of the cooling system which passage is projected outside of the outer periphery of the engine cylinder-and-block, is minimized. With the previously-noted thermostat arrangement, since the first and second thermostats 47 and 48 both exhibit a high thermosensitive characteristic, the coolant flow through the second return passage 41 can be accurately controlled, thereby assuring an optimal temperature control with regard to the cylinder block 24. The cooling system according to the present invention operates as follows.

When the coolant temperature is low, for example during cold starts, the first and second thermostats 47 and 48 which are disposed at the confluence 42 of the first and second return passages 39 and 41 and the radiator thermostat 57 are all closed. With the thermostats 47, 48 and 57 all closed, the coolant discharged from the water pump 23 can circulate through the left and right cylinder head water jackets 31 and 32 and the first return passage 39 and the bypass passage 55*b*. On the other hand, the coolant circulation through the left and right cylinder block water jackets 25 and 26 is shut off. Thus, the engine (the cylinder blocks) can reach operating temperatures more rapidly.

In the event that the temperature of coolant flowing through the first return passage 39 reaches to the predetermined operating temperature (e.g. 95° C.), the first thermostat 47 starts to open. In this case, the radiator thermostat 57 is conditioned in its open state, since the radiator thermostat 57 designated as a lower operating temperature unit than the first thermostat 47. Then, coolant can circulate through the radiator 40. Thus, coolant can circulate through the water pump 23, the cylinder head water jackets 31 and 32, the first return passage 39, and the radiator 40. With the first thermostat 47 opened, coolant can also circulate through the cylinder block water jackets 25 and 26. As a consequence, the cooling system can provide a suitable cooling effect of the cylinder heads 29 and 30 and prevent the cylinder blocks 25 and 26 from being overcooled, whereby the Working parts such as the cylinder blocks, the cylinder heads, and the valve seats can be maintained at efficient, but not excessive, operating temperatures. As set forth above, in the event that the temperature of coolant used for cooling the cylinder heads exceeds the predetermined operating temperature of the first thermostat 47, coolant can circulate through the cylinder block water jackets by way of the thermostat 47 opened, thereby preventing the cylinder liners from being overheated. Also, in the event that the temperature of coolant flowing from the cylinder heads through the first return passage 39 has risen above the predetermined upper limit corresponding to the operating temperature of the second thermostat 48, the second thermostat 48 as well as the first thermostat 47 is opened, thereby certainly preventing overheating of the engine and keeping the engine working parts within a safe temperature range. As appreciated, the cooling system of the invention can provide a high warm-up performance and maintain the temperature of the cylinder block 24 at optimal operating temperatures, thereby reducing frictional loss between the pistons and the cylinder walls, assuring a good combustion of air-fuel mixture in the engine, and consequently improving fuel consumption and reducing exhaust emissions.

Figure 10:
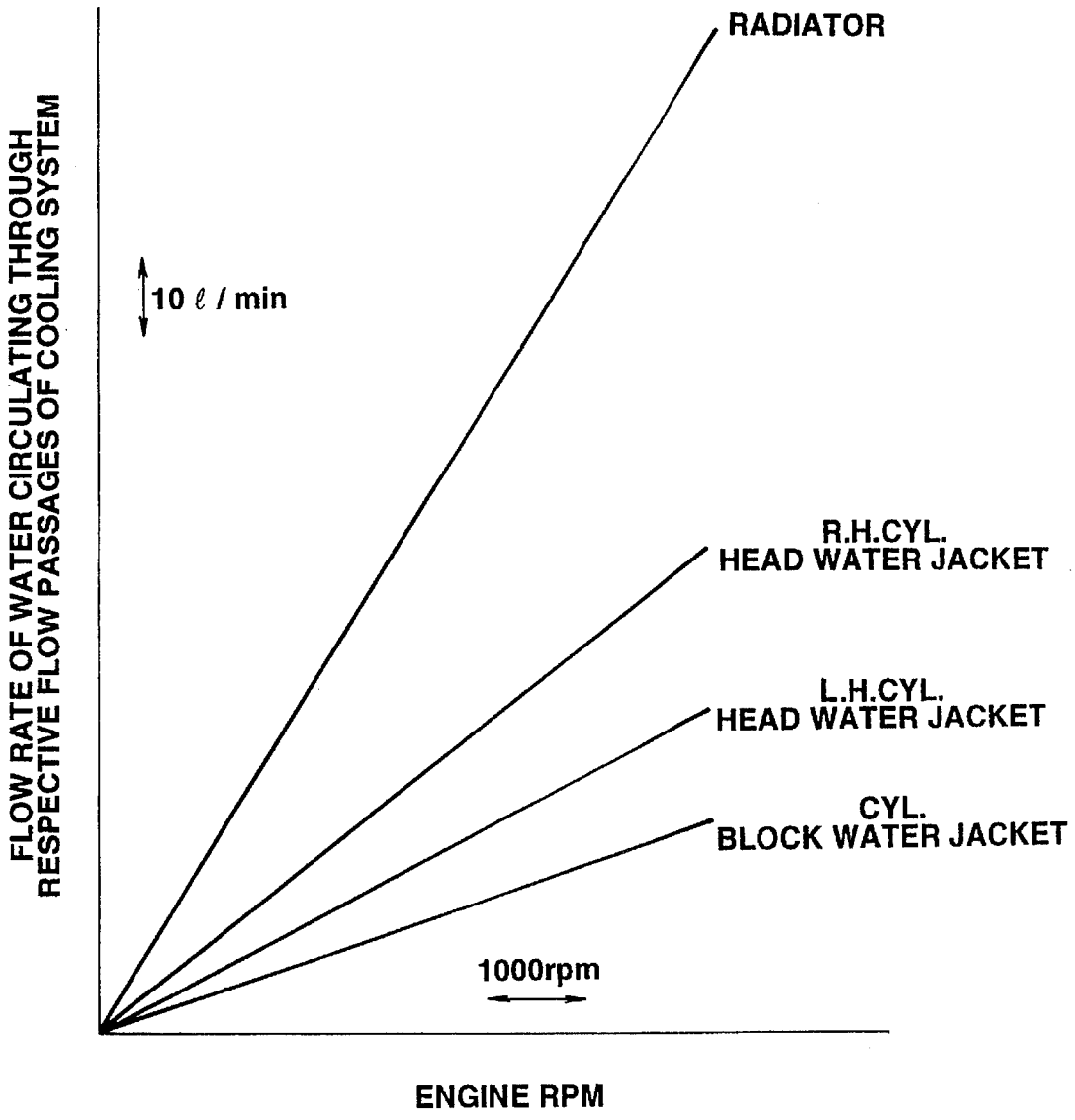
FIG. 10 is a graph illustrating a relation between an engine revolution and flow rates at respective coolant passages, namely a radiator, cylinder block water jackets, and right and left cylinder-head water jackets.

FIG. 10 shows a relationship between flow rates of coolant flowing through the respective flow passages, namely the radiator 40, the right-hand side cylinder head water jacket 32, the left-hand side cylinder head water jacket 31, the cylinder block water jackets 25 and 26, under a particular condition wherein the thermostats 47, 48 and 57 are all opened. Since with respect to the coolant return passage, the outlet 37 of the left-hand side cylinder head water jacket 31 is placed upstream of the outlet 38 of the right-hand side water jacket 32, the outflow resistance at the outlet 37 of the left cylinder head water jacket 31 is in general greater than that at the outlet 38 of the right cylinder head water jacket 32, and thus the flow rate of coolant flowing through the right cylinder head water jacket 32 tends to be greater than that of the left cylinder head water jacket 31. It will be appreciated that the flow rate of coolant flowing through the cylinder head water jackets 31 and 32 is increased in case of restriction of the coolant circulation through the cylinder block water jackets 25 and 26 with the thermostats 47 and 48 closed.

Instead of the previously-noted offset arrangement of the thermosensitive wax casings 50 of the first and second thermostats 47 and 48 with respect to the center axial line of the first return passage 39, in order to obtain the same thermosensitive characteristics between the first and second thermostats, the first and second thermostats 47 and 48 may be arranged so that the line segment joining the center portion of the thermosensitive wax casing 50 of the first thermostat 47 and the center portion of the thermosensitive wax casing 50 of the second thermostat 48, is arranged obliquely to the central axial line of the first return passage 39 towards the center of the engine. In this case, the thermostat housing must be provided in a manner which is obliquely arranged with respect to the central axial line of the first return passage 39. Such an oblique arrangement of the thermostats 47 and 48 causes the thermostats to be exposed more uniformly and adequately to the coolant flowing through the first return passage 39.

As will be appreciated from the above, since the thermosensitive portions (the wax casings 50) of the additional thermostatic valve device 43 provided at the confluence 42 between the first and second return passages 39 and 41, are arranged to be exposed or immersed into the coolant flowing from the left-hand side cylinder head water jacket 31 through the first return passage 39, the thermostatic valve device 43 can reliably operate with a high response depending on the coolant temperature of coolant flowing constantly through the first return passage 39 during operation of the engine. Owing to a greater outflow resistance at the outlet of the left cylinder head water jacket 31 than the outlet of the right cylinder head water jacket 32, the temperature of coolant coming from the outlet 37 of the left cylinder head water jacket 31 tends to be higher than the coolant temperature at the outlet 38 of the right cylinder head water jacket 32. Additionally, since the thermosensitive portions (the wax casings 50) of the thermostatic valve device 43 are arranged to sense the temperature of coolant coming from the outlet 37 of the left cylinder head water jacket 31 into the first return passage 39, the thermostatic valve device 43 can be operated precisely without any time delay, so as to cause the second return passage to be precisely opened or closed.

Also, since the water pump 23 is provided at the previously-noted front-left bank-offset space and a junction 60 between the first return passages 39 and the outlet 38 of the right cylinder head water jacket 32 is provided at the previously-noted rear-right bank-offset space, the entire length of the engine assembly may be minimized. In addition, as explained previously, the cross-sectional area of the upstream portion of the first return passage 39 can be dimensioned smaller as compared with the downstream portion, because a relatively small flow rate of coolant coming from only the left cylinder head water jacket 31 passes through the upstream portion of the first return passage 39. Thus, the first return passage 39 can be further approached to the back end surface of the engine at the upstream portion of the first return passage 39. In the embodiment, although the outlets 37 and 38 of the respective cylinder head water jackets 31 and 32 are formed at the back end walls of the cylinder heads, these outlets 37 and 38 may be formed at the inside walls of cylinder heads by suitably modifying the shape of a conduit used to connect to the first return passage 39 and by properly shifting the position of the junction 60 between the first return passage 39 and the outlet 38 of the right cylinder head water jacket 32.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A cooling system for a liquid-cooled engine, comprising:

a cylinder head water jacket;

a cylinder block water jacket;

a water pump arranged for forcing cooling water from its pump outlet to each of the water jackets;

a radiator thermostat for restricting circulation of cooling water through a radiator when the engine is cold;

a first return passage for returning cooling water coming from said cylinder head water jacket to a pump inlet of said water pump, said radiator being disposed between said water pump and said first return passage for removing heat from cooling water flowing therethrough;

a second return passage for returning cooling water coming from said cylinder block water jacket to the pump inlet, said second return passage joining said first return passage at a junction so that a flow of cooling water coming from said cylinder block water jacket joins a flow of cooling water coming from said cylinder head water jacket; and thermostatic valve means disposed in said junction of said first and second return passages for selectively passing through and blocking a flow from said second return passage and having a thermosensitive portion exposed to said first return passage so that a fluid communication between said first and second return passages is established when a temperature of cooling water flowing through said first return passage is above a predetermined temperature.

2. The cooling system as set forth in claim 1, wherein said thermostatic valve means comprises at least two adjacent thermostats, and said thermostats are arranged so that a center portion of said thermosensitive portion of each thermostat is offset from a center axial line of said first return passage.

3. The cooling system as set forth in claim 2, wherein the center portion of said thermosensitive portion of each thermostat is offset from the center axial line of said first return passage in a direction toward a bottom part of the engine.

4. The cooling system as set forth in claim 2, wherein each of said at least two adjacent thermostats consists of a wax-pellet thermostat, said thermosensitive portion of each thermostat consists of a wax casing of the wax-pellet thermostat, and an offset between the center portion of said thermosensitive portion and the center axial line of said first return passage is set to be greater than a radius of said wax casing.

5. The cooling system as set forth in claim 2, wherein an upstream one of said two adjacent thermostats has a thermostat operating temperature lower than a lower one of said two adjacent thermostats, and said radiator thermostat has a thermostat operating temperature lower than said upstream one of said two adjacent thermostats.

6. The cooling system as set forth in claim 1, wherein said thermostatic valve means comprises at least two adjacent thermostats, and said thermostats are arranged so that a line segment joining center portions of thermosensitive portions of each thermostats is arranged obliquely to a center axial line of said first return passage.

7. The cooling system as set forth in claim 6, wherein said line segment is arranged obliquely to the center axial line of said first return passage in a direction toward a bottom part of the engine.

8. The cooling system as set forth in claim 6, wherein an upstream one of said two adjacent thermostats has a thermostat operating temperature lower than a lower one of said two adjacent thermostats, and said radiator thermostat has a thermostat operating temperature lower than said upstream one of said two adjacent thermostats.

9. A cooling system for a liquid-cooled V-type engine equipped with two cylinder banks, comprising:

a water pump arranged for forcing cooling water from its pump outlet to cylinder head water jackets and cylinder block water jackets;

a radiator thermostat for restricting circulation of cooling water through a radiator when the engine is cold;

a first return passage connected to an outlet of a cylinder head water jacket arranged in a first bank of said two cylinder banks at its upstream portion and to an outlet of a cylinder head water jacket arranged in a second bank of said two cylinder banks at its downstream portion, for returning cooling water coming from said cylinder head water jackets to a pump inlet of said water pump, the upstream portion of said first return passage having a greater outflow resistance than the downstream portion of said first return passage, said radiator being disposed between said water pump and said first return passage for removing heat from cooling water flowing therethrough;

a second return passage for returning cooling water coming from said cylinder block water jackets to the pump inlet, said second return passage joining said first return passage at a junction so that a flow of cooling water coming from said cylinder block water jackets joins a flow of cooling water coming from said cylinder head water jackets; and thermostatic valve means disposed in said junction of said first and second return passages for selectively passing through and blocking a flow from said second return passage, said thermostatic valve means being sensitive to a temperature of cooling water coming from the cylinder head water jacket of said first bank so that a fluid communication between said first and second return passages is established when the temperature of cooling water coming from the cylinder head water jacket of said first bank is above a predetermined temperature.

10. A cooling system for a liquid-cooled V-type engine equipped with left and right cylinder banks being offset from each other, comprising:

a water pump arranged adjacent to said left bank at a front bank-offset space so that a pump outlet of said water pump is connected to cylinder head water jackets and to cylinder block water jackets; and a return passage connected to an outlet of a cylinder head water jacket arranged in said left bank at its upstream portion and to an outlet of a cylinder head water jacket arranged in said right bank at its downstream portion, for returning cooling water coming from said cylinder head water jackets to a pump inlet of said water pump, wherein a junction between said return passage and the outlet of the cylinder head water jacket arranged in said right bank is provided at a rear bank-offset space, and wherein said return passage is arranged along and close to an outer periphery of the engine and branched into an inlet passage of a radiator and a bypass passage connected to the pump inlet.

* * * * *